US005146993A

United States Patent [19]

Gambertoglio

[11] Patent Number: 5,146,993

[45] Date of Patent: Sep. 15, 1992

[54] PACKING MECHANISM FOR SUBTERRANEAN WELLS

[76] Inventor: Louis M. Gambertoglio, 195 S. Deerfoot Cir., The Woodlands, Tex. 77380

[21] Appl. No.: 549,218

[22] Filed: Jul. 6, 1990

[51] Int. Cl.[5] ..... E21B 33/129

[52] U.S. Cl. ..... 166/387; 166/138; 166/139

[58] Field of Search ..... 166/387, 118, 138, 139, 166/179, 192, 202, 216, 217

[56] References Cited

U.S. PATENT DOCUMENTS

| | | | |
|---|---|---|---|
| 3,470,951 | 10/1969 | McGill | 166/139 |
| 3,684,010 | 8/1972 | Young | 166/139 |
| 4,078,606 | 3/1978 | Montgomery | 166/138 |
| 4,518,037 | 5/1985 | Youngblood et al. | 166/138 |
| 4,611,658 | 9/1986 | Salerni et al. | 166/138 |

*Primary Examiner*—Terry L. Melius

[57] ABSTRACT

A downhole packing mechanism for achieving sealed engagement with the bore of a well conduit comprises a mandrel positionable within a well by a tubing string. Surrounding the mandrel is a tubular body assemblage which is connectable to the mandrel for run-in purposes by a control dog and slot arrangement. An annular packing element surrounds the upper end of the tubular body assemblage and is compressed into sealing engagement with the well bore conduit by an upper slip assembly. A lower slip assembly surrounds the tubular body assemblage and is detachably engagable with the mandrel for setting by initial upward movement of the mandrel. Subsequent upward movement of the mandrel effects the upward movement of the upper slip assembly, the compression of the annular packing element into sealing engagement with the well conduit and the setting of the upper slip assembly. The device may be used as a packer, bridge plug, tubing hanger, or the like.

19 Claims, 10 Drawing Sheets

PACKING MECHANISM FOR SUBTERRANEAN WELLS

BACKGROUND OF THE INVENTION

1. Field of the Invention

The invention relates to a packing mechanism for achieving a sealed relationship with the bore of a well conduit, which may be employed on packers, bridge plugs, tubing hangers or the like.

2. Summary of the Prior Art

Packers and bridge plugs have long been utilized in the oil and gas well industry to achieve a sealing engagement at a selected position with the bore of a well conduit, such as a casing or a tubing string. Such prior art mechanisms generally incorporate an axially compressible annular sealing unit disposed intermediate an upper slip mechanism and a lower slip mechanism. Conventionally, upward movement of the lower slip mechanism, produced by a mandrel, was transmitted to the annular sealing units and then to the upper slip element to achieve the compression, hence radial expansion of the annular packing element and the setting of the upper and lower slip elements.

This prior art arrangement has the distinct disadvantage in that the upper slip elements are exposed to the well fluids existing in the well conduit above the sealing mechanism. Hence, the upper slips are subject to accumulation of particulates and debris in and around the slip units and the cone for operating the slip units. Such accumulated particulates or other debris can often result in the failure of the upper slip mechanism to properly function.

There is a need, therefore, for a sealing mechanism for use on packers, bridge plugs, or the like wherein an annular packing element is disposed above both the upper and lower slip mechanisms, thus protecting such mechanisms from the deleterious effects of accumulation of particulates and other debris. There is the further need for a bridge plug mechanism that can be utilized below a conventional packer and the combination can be set, then unset and moved to another position in the well without requiring more than one trip into the well.

SUMMARY OF THE INVENTION

An elongated mandrel is provided which is conventionally insertable in the well by a tubing string. Surrounding the mandrel is a tubular body assemblage. The tubular body assemblage is carried into the well by a control dog and slot arrangement having the unusual characteristic of being disengagable by clockwise rotation accompanied by a tensile force on the mandrel and being re-engagable by further clockwise rotation of the mandrel accompanied by a downward force on the mandrel. The lower end of the tubular body assemblage mounts a set of conventional drag blocks which are engagable with the well conduit bore to permit rotational movement of the mandrel with respect to the tubular body assemblage.

At the upper end of the tubular body assemblage, an abutment shoulder is provided. Immediately below the abutment shoulder, an axially elongated annular packing unit is provided which, when subjected to a compressive force, expands radially into sealing engagement with the bore wall of the well conduit. Immediately below and abutting the packing unit is an upper slip assemblage including an upper cone, a slip carrier and upper slips cooperable with the upper cone to be moved outwardly into biting engagement with the well bore conduit upon upward movement of the upper slip assembly which is, of course, resisted by the annular packing element.

A lower slip assembly is mounted around the tubular body assemblage at a position below the upper slip assembly and operates entirely independently of the upper slip assembly. Such lower slip assembly may incorporate a lower cone, a lower slip holder and a plurality of peripherally spaced slips cooperable with the lower cone to be expanded into biting engagement with the conduit bore wall.

The lower slip assembly is set by the limited upward movement of the mandrel involved in effecting the release of the mandrel from the tubular body assemblage. Such setting of the lower slips is accomplished by a collet having a ring portion surrounding the mandrel. A radial pin is secured to the collet ring portion and projects through an axial slot in the tubular body assemblage to engage a movable portion of the lower slip assembly. Such movable portion could be either the slip carrier or the lower cone, depending upon which of several conventional configurations of slip assemblies is selected for use.

The latching heads of the collet are provided with grooves or threads on their outer surfaces which cooperate with wicker threads provided on the internal bore of the outer tubular body assemblage. In the run-in position of the mandrel, such latching heads are disposed in an annular recess provided on the exterior of the mandrel. As the mandrel is moved upwardly, the collet and movable element of the lower slip assembly are concurrently moved upwardly by the lower wall of the annular recess until the slip is set. Once the slip is set, further upward movement of the mandrel cams the locking heads into fixed engagement with the wicker threads on the internal bore surface of the outer tubular assembly and permits the mandrel to move further upwardly to effect the setting of the upper slip assembly and the compression of the packing element.

The setting of the upper slip assembly is accomplished by an abutment on the mandrel which engages a setting ring surrounding the mandrel having a radial pin portion protruding through an axial slot in the tubular body assemblage and engaging either the upper slip carrier or the upper slip cone, depending upon whether one or the other of such elements constitutes the lowermost portion of the upper slip assembly.

The further upward movement of the mandrel thus effects an upward movement of the upper slip assembly which translates into a compressive force exerted on the annular packing unit. Thus, the packing unit is expanded by compression into sealing engagement with the internal bore surface of the conduit and the upper slips are then expanded into biting engagement with such conduit bore wall.

After the setting of the lower slip assembly by the initial upward movement of the mandrel, one or more spring pressed locking elements mounted in the bore wall of the outer tubular assemblage move inwardly into engagement with wicker threads provided on the mandrel. Thus, retraction or downward movement of the mandrel is prevented, and when both slip assemblies and the packing unit are set, such wicker threads maintain the setting forces.

The wicker locking threads provided on the mandrel are releasable from the spring pressed locks by rotation of the mandrel in a clockwise direction. This moves the mandrel downwardly relative to the tubular body assemblage and appropriate abutments on the mandrel engage the upper slip assembly and the lower slip assembly to unset such assemblies. The locks are disengaged rotationally prior to the conclusion of such rotation of the mandrel, and the control dog and slot connections between the mandrel and the outer tubular assemblage are positioned to interengage as the mandrel moves down to its run-in position, so that the entire assemblage can be retrieved from the well by upward movement of the mandrel, or positioned and re-set above or below the previous location in the conduit.

In high pressure environments, the forces on the locking elements may cause such elements to jump over the wicker threads, particularly during the unsetting rotation of the mandrel. To prevent such undesirable occurrence without complicating the unsetting procedure, a supplemental collet may be provided intermediate the mandrel and an internal recess formed in the tubular body assemblage. The collet heads are provided with internal threads which are outwardly displaced from engagement with an elongated, externally threaded portion of the mandrel as the mandrel moves upwardly toward the setting position for the upper slips.

As the mandrel abutment engages the setting ring for the upper slips, spring biased lock segments positioned adjacent the ring portion of the supplemental locking collet move inwardly into engagement with an annular recess on the mandrel and cause the collet to move upwardly with the mandrel. Such upward movement brings the collet heads into engagement with an inclined upper end surface of the internal recess to force the collet heads inwardly to engage the threaded portion of the mandrel and positively lock the mandrel against axial displacement relative to the collet, except by relative rotation.

To unset the packing assembly, the mandrel is rotated in a clockwise direction. The collet is secured against rotation by a pin and slot connection to the tubular body assemblage, and against any substantial upward movement by an internal shoulder on the tubular body assemblage, so the mandrel is moved downwardly by the thread action of the threaded collet heads, unsetting the packing assembly.

Further advantages of the invention will be readily apparent to those skilled in the art from the following detailed description, taken in conjunction with the annexed sheets of drawings, on which is shown a preferred embodiment of the invention.

DESCRIPTION OF PREFERRED EMBODIMENTS

Figure 1A:
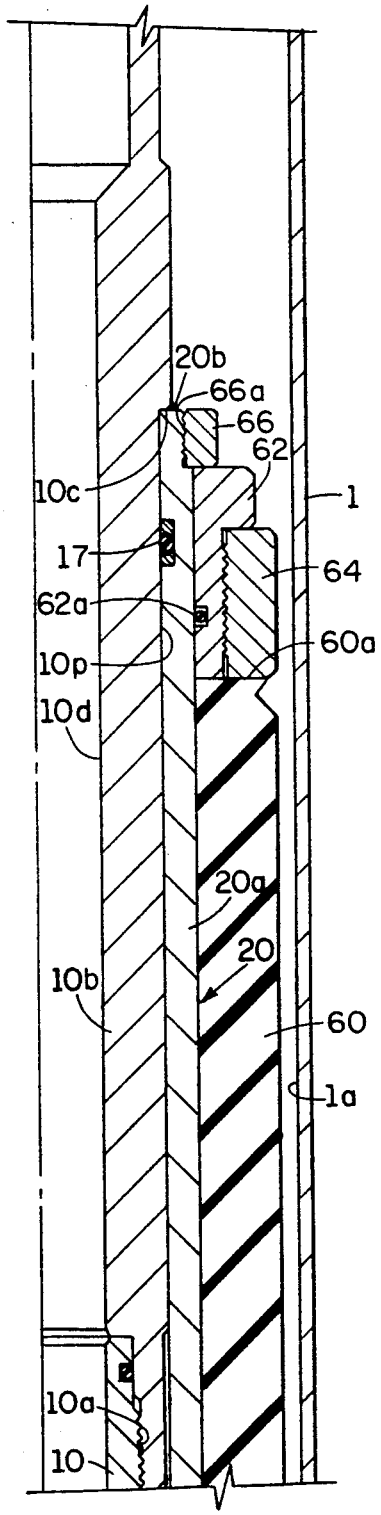
FIGS. 1A, 1B . . . 1D collectively represent a vertical quarter sectional view of a packing mechanism embodying this invention with the components thereof shown in a run-in position with respect to a well conduit.
Figure 2A:
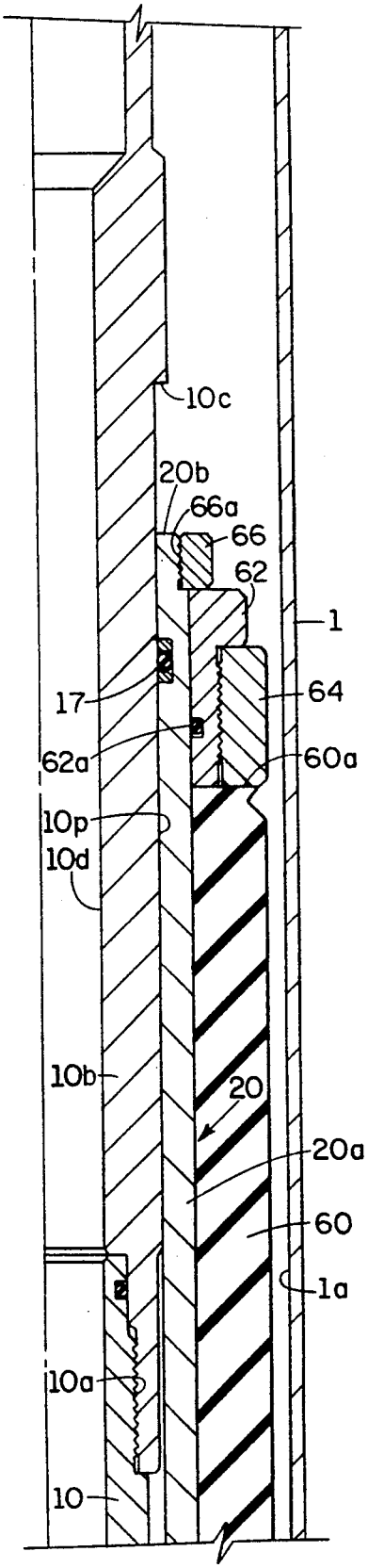
FIGS. 2A, 2B . . . 2D are views respectively similar to FIGS. 1A, 1B . . . 1D but showing the components after the release of the mandrel from the control dog and slot connection and the upward movement of the mandrel to effect the setting of the lower slip assembly.
Figure 1B:
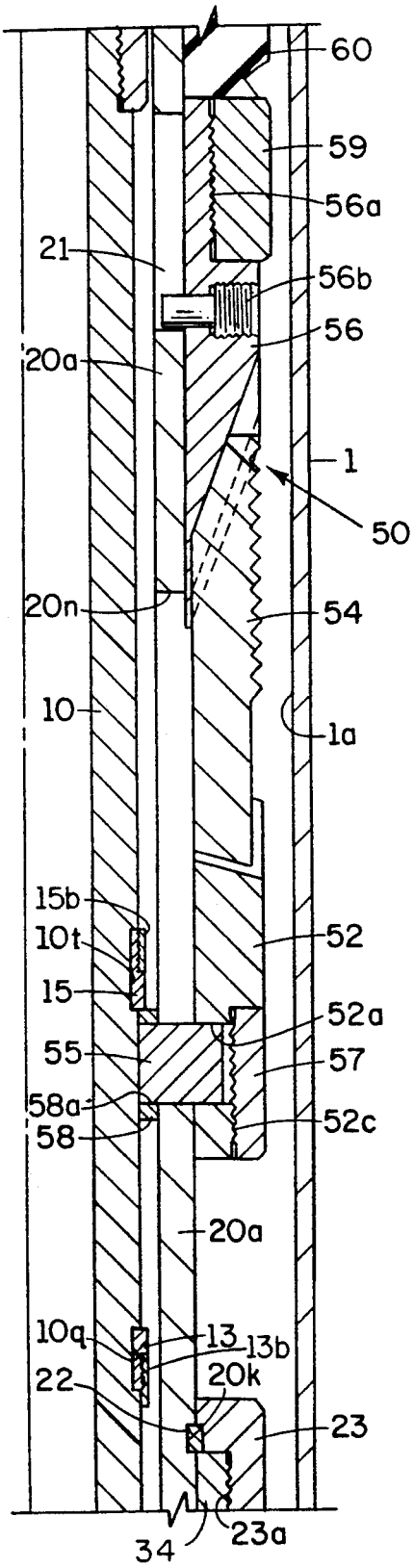
Figure 2B:
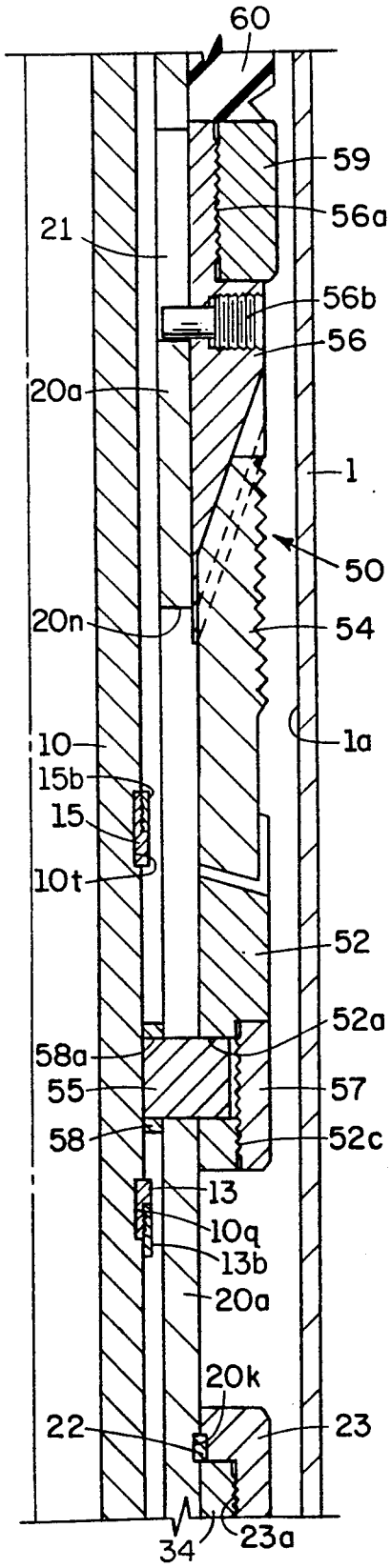

Referring to FIGS. 1A, 1B . . . 1D, there is shown a hollow mandrel assemblage comprising an elongated mandrel 10 having external threads **10*a* at its top end for securement to a connecting sub 10*b*. Connecting sub 10*b* is conventionally connected to a tubing string (not shown) by which the mandrel 10 is inserted and retrieved from the well conduit 1**.

Figure 1C:
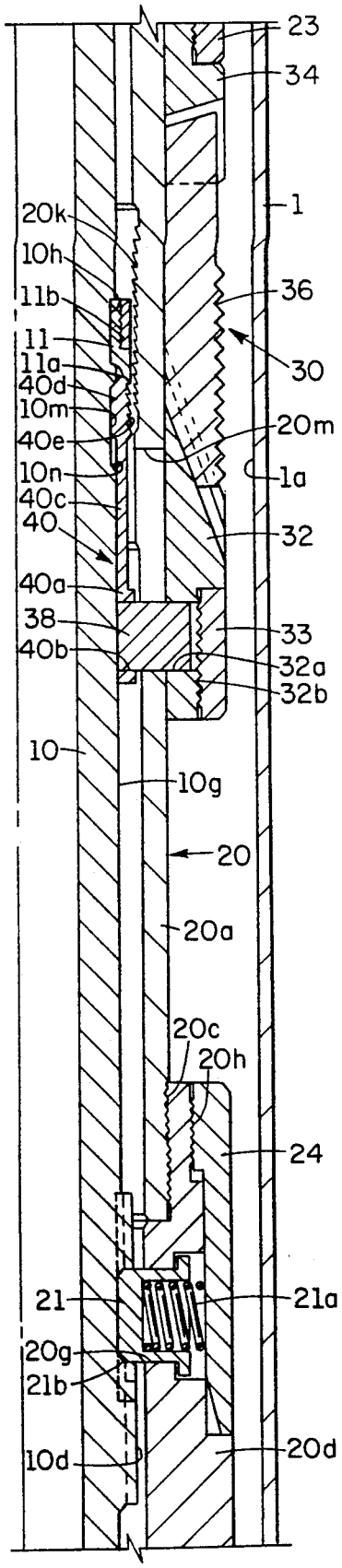
Figure 2C:
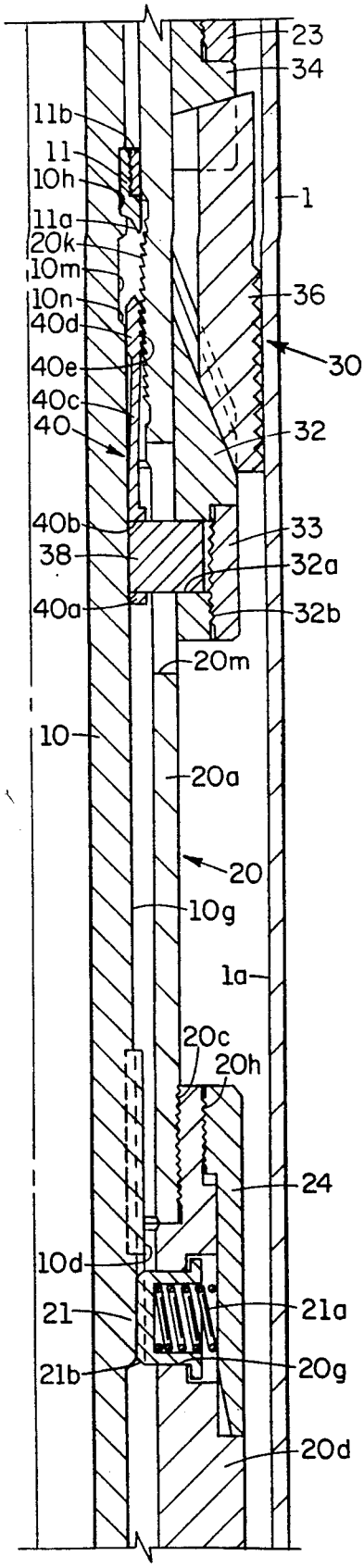
Figure 1D:
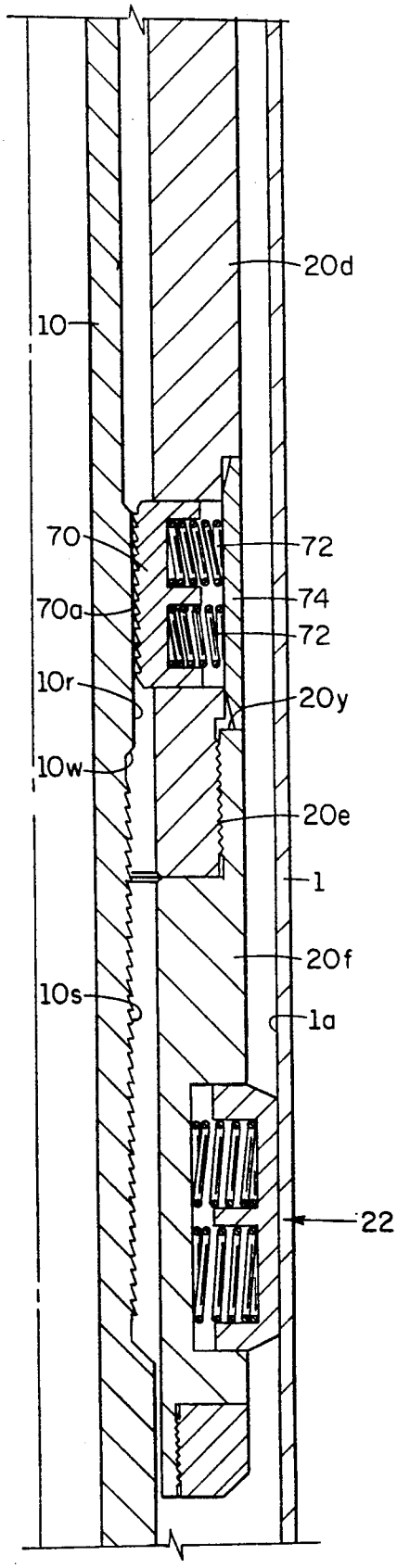
Figure 2D:
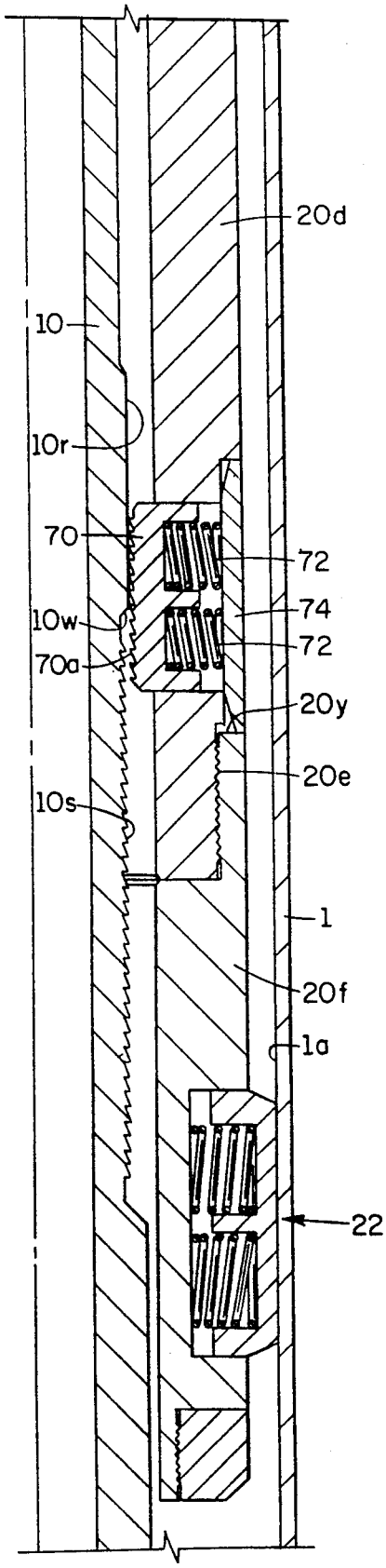

Connecting sub **10*b* is provided with an external downwardly facing shoulder 10*c* which provides an abutment for the top end of a tubular body assemblage 20 which telescopically surrounds the mandrel assemblage. Tubular body assemblage 20 includes an upper portion 20*a* having a top end face 20*b* in abutment with mandrel shoulder 10*c*. The lower end of upper body portion 20*a* is provided with external threads 20*c* (FIG. 1C) to which an intermediate thick-walled sleeve 20*d* is threadably secured. The bottom end of intermediate sleeve 20*d* is provided with external threads 20*e* to which is secured a bottom sleeve portion 20*f* (FIG. 1D). A conventional drag block assemblage 22 is mounted in the bottom sleeve portion 20*f* and frictionally engages the bore wall 1*a* of the conduit 1**.

Figure 4:
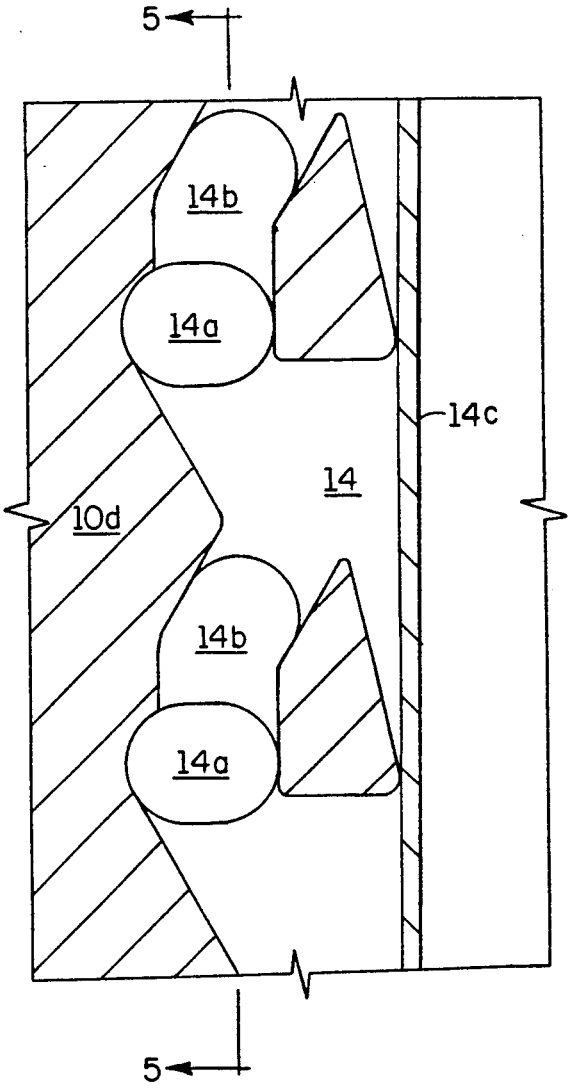
FIG. 4 is a developed view of the cam slot of the control dog and slot connection.
Figure 5:
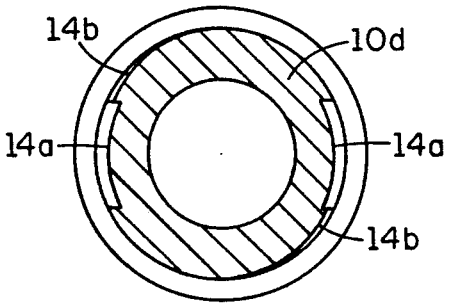
FIG. 5 is a sectional view taken on the plane 5—5 of FIG. 4.

A non-conventional control dog and slot connection is provided between the intermediate sleeve portion **20*d* of the tubular body assemblage 20 and the mandrel 10. Intermediate sleeve portion 20*d* is provided with a radial bore 20*g* (FIG. 1C) within which is mounted a control dog 21 (FIG. 1C). Control dog 21 is biased inwardly by a spring 21*a* which abuts a retaining sleeve 24 secured to external threads 20*h* provided on the top end of the intermediate sleeve portion 20*d*. The beveled end 21*b* of spring biased control dog 21 engages a specially designed ramp slot 14 formed in an enlarged shoulder portion 10*d* of the mandrel 10. In the preferred embodiment, two control dogs 21 are provided in diametrically spaced relationship which respectively cooperate with two diametrically spaced ramp slots 14. As best shown in the topographic view of FIG. 4, each slot 14 includes a short vertical portion 14*a* which communicates at its bottom with a ramped slotted portion 14*b* (FIG. 4) which has the effect of elevating the control dog 21 as the mandrel 10 is rotated in a clockwise direction. Concurrent application of tension to mandrel 10 permits the control dogs 21 to move downwardly around the respective ramp 14*b* and then up an annular ramp 14*c*, thus freeing the mandrel 10 for unrestricted upward movement relative to the tubular body assemblage 20. As is customary, the spring pressed guide blocks 22 resist rotational movement of the tubular body assemblage 20 sufficient to permit the disengaging rotational and upward movement of the mandrel 10** involved in releasing the control dog and slot connection previously described.

Above the end of the intermediate tubular body portion 20*d*, a lower slip assembly 30 is provided in surrounding relationship to the upper sleeve portion 20*a* of the tubular body assemblage 20. Such slip assemblage comprises a tubular lower cone 32, an upper slip carrier 34 and a plurality of peripherally spaced slips 36 mounted intermediate the lower cone 32 and the slip carrier 34. Those skilled in the art will recognize that the relative positions of the slip cone and slip carrier could be reversed, if desired, and other conventional arrangements of lower slip assemblies could be employed.

As shown in FIG. 1B, the slip retainer 34 is secured against upward movement relative to the upper body sleeve 20*a* by a C-ring 22 (FIG. 1B) mounted in an annular groove 20*k* provided on the exterior of sleeve portion 20*a* of the tubular assemblage 20. A retaining ring 23 surrounds C-ring 22 and is secured by threads 23*a* to slip retainer 34.

The movable element of the lower slip assembly 30, which in this case is the lower cone 32, is provided with a radial bore 32*a* into which a radial pin 38 projects, passing through an axial slot 20*m* in the tubular body assemblage 20. The radially inner end of pin 38 engages in a bore 40*b* provided in the ring portion 40*a* of a collet 40 and is retained in position by a sleeve 33 which engages threads 32*b* on lower cone 32. Collet 40 has a plurality of peripherally spaced, upwardly extending arm portions 40*c* which respectively terminate in enlarged head portions 40*d*. The radially outer faces of head portions 40*d* are provided with ratchet threads 40*e* which can cooperate with internal wicker threads 20*k* provided on the inner surface of the upper sleeve portion 20*a*. In the run-in position of the apparatus shown in FIG. 1C, the collet heads 40*d* are restrained from movement into engagement with wicker threads 20*k* by a split retaining ring 11 which is conventionally secured in an appropriate annular groove 10*h* formed on the exterior of mandrel 10 by a threaded cap 11*b*. Split ring 11 has a depending rib potion 11*a* overlying the ends of the collet heads 40*d*.

It should be noted that the collet heads 40*d* in their run-in positions are held within a recess 10*m* formed on the exterior of the mandrel 10. The lower end of recess 10*m* is just slightly inclined as indicated at 10*n* so that upward movement of the mandrel 10 will first move retaining ring 11 off collet heads 40*d* and then impart an upward movement to the collet heads heads 40*d*, thus moving the lower cone 32 upwardly by radial pin 38 and effecting the setting of the slips 36. Once the slips 36 are set, further upward movement of the collet heads 40*d* is prevented and the upwardly facing inclined shoulder 10*n* provided on the bottom end of the mandrel recess 10*m* rides under the collet heads 40*d* and the larger diameter normal surface 10*g* of mandrel 10 retains the collet heads in a locked position in the wicker threads 20*k*, thus locking the lower slip assembly in its set position.

An upper slip assemblage 50 (FIG. 1B) is mounted in surrounding relationship to the upper sleeve portion 20*a* of the tubular housing assemblage 20 at a point above the slip retainer 34 of the lower slip assembly 30. The upper slip assembly 50 is generally similar to the lower slip assembly 30 and includes a slip retainer 52, an upper cone 56 and a plurality of peripherally spaced slips 54 mounted intermediate the upper slip retainer 52 and the upper cone 56. The relative positions of the upper slip retainer and the upper slip cone may be reversed, or any other conventional assembly of a cone, slips and retainer may be utilized. The important thing is that the entire upper slip assembly 50 is movable relative to the upper sleeve portion 20*a* of the tubular body assemblage 20. A torque pin 56*b* may be provided in upper cone 56 which engages an axially extending slot 21 in the tubular body assemblage 20.

An axially extending slot 20*n* is provided in the tubular body assemblage 20 underlying the upper slip assembly 50. A radial bore 52*a* is provided in the upper slip retainer 52 and a radial pin 55 extends through such radial hole into engagement with a hole 58*a* provided in a ring 58 secured to the exterior of the mandrel 10. Pin 55 is retained in the assemblage by a sleeve 57 which is secured by threads 52*c* to the bottom end of the upper slip retainer 52.

A gage ring 59 is secured by threads 56*a* to the top end of the upper cone 56. The end surfaces of gage ring 59 and upper cone 56 abut the bottom end of an annular compressible packing element 60. While for simplicity of illustration, the element 60 is shown as a single elastomeric sleeve, those skilled in the art will recognize that any packing assemblage that is operable by the application of a compressive force thereto may be utilized.

The upper end 60*a* of annular packing element 60 engages an abutment structure comprising a sleeve 62 (FIG. 1A) sealably mounted on the exterior of the upper sleeve portion 20*a* of the tubular housing assemblage 20 by an O-ring 62*a*. Sleeve portion 62 has external threads which mount a gage ring 64 and the bottom end faces of gage ring 64 and sleeve 62 form an abutment for the top end 60*a* of the annular packing element 60. The upward movement of the packing element 60 is restrained by an abutment ring 66 which is secured by threads 66*a* to the extreme top end of the tubular body assemblage 20. It should be noted that the top portions of the upper sleeve 20*a* of the tubular body assemblage 20 is slidably engaged with an external surface 10*p* provided on the mandrel 10 which terminates in the downwardly facing shoulder 10*c*. O-ring seal 17 with back-up rings 17*a* are provided to seal this slidable interengagement.

The compression of the annular packing element 60, followed by the setting of the upper slips 56 is accomplished by a split ring 13 (FIG. 1B) which is conventionally secured in an appropriate annular groove 10*q* provided on the exterior of the mandrel 10 by a cap 13*b*. The spacing of the abutment ring 13 relative to the radial pin 55 is such that the lower slip assembly 30 is completely set before the abutment ring 13 engages the force transmitting ring 58 which imparts an upward movement to the slip retainer 52 by the pin 55, hence to the entire upper slip assembly 50 and the annular packing element 60. Thus, these elements are advanced to their set position by further upward movement of mandrel 10 subsequent to the setting of the lower slips and entirely independently of the setting of such lower slips. The annular packing element 60 is first compressed into sealing engagement with the internal bore wall 1*a* of conduit 1 and this prevents further upward movement of the cone 56, thus permitting the slips 54 to be shifted radially outwardly into biting engagement with the conduit bore wall 1*a*.

The entire packing assembly is retained in the set position by one or more radially shiftable lock elements 70 (FIG. 1D) which are mounted in the bottom portion 20*d* of the tubular body assemblage 20. Such lock elements 70 carry thread segments 70*a* on their inner ends and are biased radially inwardly by one or more springs 72. Springs 72 react against a cover sleeve 74 which is secured in position by the top end 25*a* of the bottom sleeve portion 20*f* which, as previously mentioned, is secured to the bottom end of the tubular body assemblage 20 by threads 20*e*.

In the run-in position of the apparatus, the lock elements 70 rest against an enlarged shoulder 10*r* provided on the lower portion of the mandrel 10. As the mandrel is elevated, the lock elements 70 ride off the shoulder 10*r* and engage clockwise wicker threads 10*s* which extend axially along the external surface of the mandrel 10.

To unset the packing assemblage, the mandrel 10 is rotated in a clockwise direction. Mandrel 10 is advanced downwardly by threads 10*s* until the enlarged shoulder 10*r* contacts the lock elements. A downwardly facing sloped surface 10*w* forces the lock segments 70 outwardly to release from mandrel threads 10*s*. The downward movement of mandrel effects the unsetting of the entire packing assemblage. Such unsetting action is accomplished by an abutment C-ring 15 which is mounted in an annular groove 10*t* provided on the exterior of the mandrel 10, secured by a cap 15*a*, and movable by downward movement of the mandrel 10 into engagement with the upper side of the ring 58, thus pulling the slip retainer 52 downwardly through the radial pin connection 55. This releases the setting forces on packing element 60 and upper slip assembly 50. The lower slip assembly 30 is unset by the abutment ring 11 moving into engagement with the collet heads 40*d*, pulling such heads out of engagement with the wicker threads 20*k* and moving the collet 40 downwardly. This effects a downward movement of the lower cone 32 through the connecting pin 38.

As the mandrel 10 completes its downward and rotational movement, the spring pressed control dogs 21 are positioned to re-enter the slot 14, and further downward and clockwise movement of the mandrel will effect the return of the control dogs and slot connections to their original run-in position in slot portion 14*a*.

From the foregoing description, those skilled in the art will appreciate that a unique packing assemblage is provided by this invention. Not only are all of the slip assemblies protected from the accumulation of particulates and/or well debris by the location of the packing element 60 above the upper slip assembly 50 and the lower slip assembly 30, but the entire setting operation is accomplished by an upward movement of the mandrel 10 resulting, of course, from the application of tension to the supporting tubing string. Initial rotation of the mandrel 10 in a clockwise direction with tension thereon is necessary to effect the release of the control dog and slot interconnections of the mandrel 10 and the tubular body assemblage 20.

The unsetting of the packing assemblage is accomplished by rotation in the clockwise direction of the mandrel 10, which may be accompanied by the application of a setdown force. The rotation results in the mandrel threads 10*s* moving downwardly relative to the locking segments 70. The downward movement of the mandrel 10 effects the unsetting of the annular packing elements 60, the upper slip assembly 50 and the lower slip assembly 30 by engagement of abutment ring 15 with force transmitting collar 58 and the engagement of split retaining ring 11 with the collet heads 40*d*. When this is accomplished, the control dogs 21 are aligned with the entry portion of the slot 14 and effect the reconnection of the mandrel 10 to the tubular body assemblage 20. Thus, the entire packing assemblage may be removed by upward movement of the tubing string supporting the mandrel 10 or repositioned and re-set above or below the previous location.

Figure 3A:
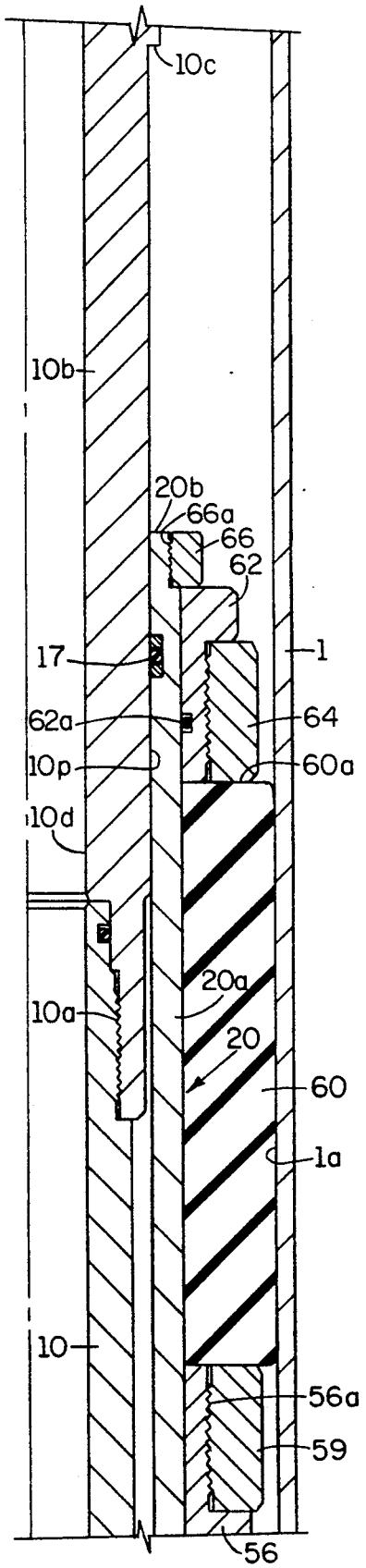
FIGS. 3A, 3B . . . 3D are views respectively similar to FIGS. 1A, 1B . . . 1D but showing the upper slip assembly and the annular compressible packing unit in their set positions in engagement with conduit bore wall.
Figure 3B:
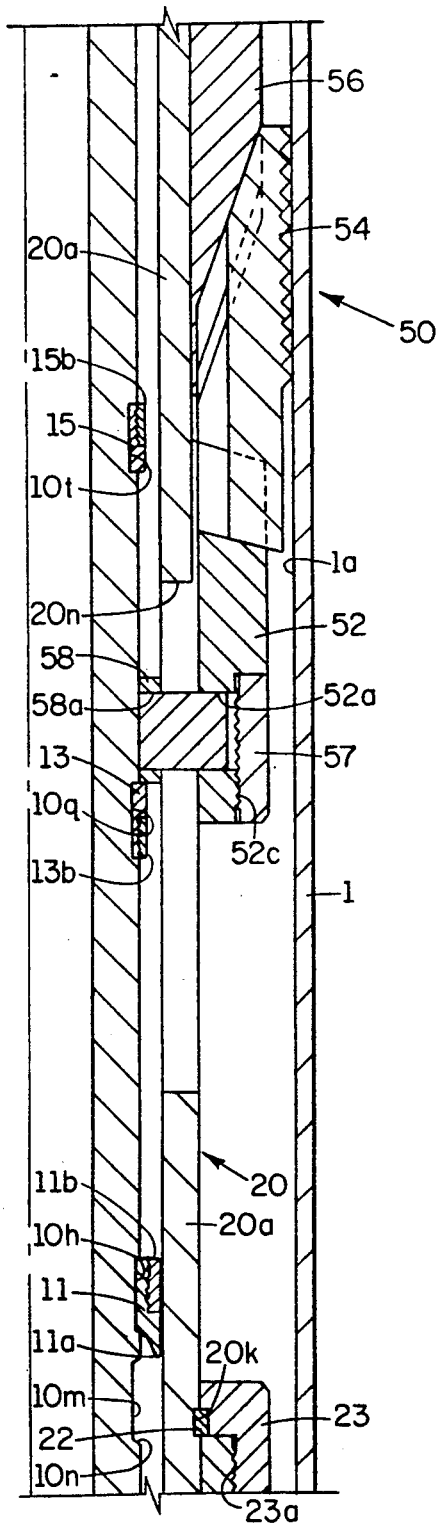
Figure 3C:
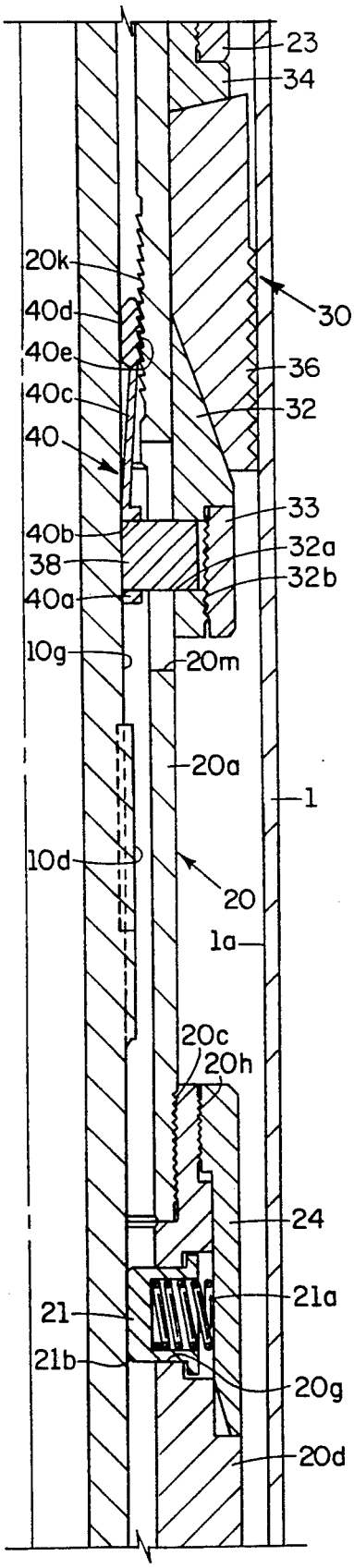
Figure 3D:
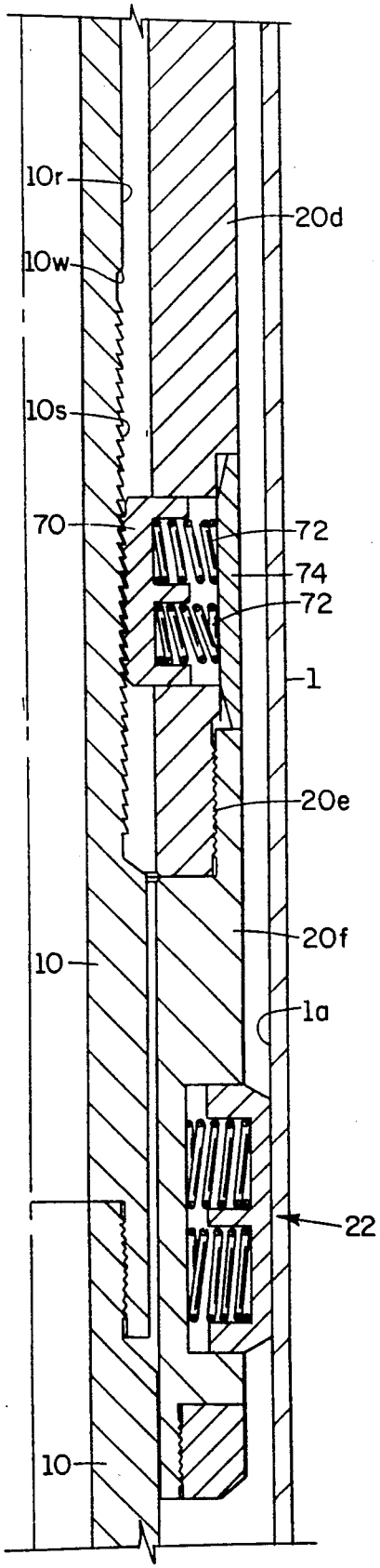

In the event that the aforedescribed apparatus is employed in wells wherein high pressures are encountered, it has been observed that the locking of the upper and lower slips in their position by the radially shiftable locking dogs 70 (FIG. 3D) may result in the locking dogs jumping over the ratcheting threads 10*s* provided on the surface of the lower portion of the mandrel 10, at least during the unsetting rotation of mandrel 10. To overcome this problem, the embodiment of this invention illustrated in FIGS. 6A and 6B may be employed. In this embodiment, wherein similar numerals represent parts previously described, a supplemental collet 80 is incorporated in the annnnular space between the mandrel 10 and the bore of the upper portion 20*a* of the tubular body assemblage 20. The collet 80 has a ring portion 80*a* slidably engaging an elongated threaded portion 10*y* provided on the mandrel 10. Peripherally spaced, upwardly extending arm portions 80*b* on the collet 80 terminate in radially enlarged locking heads 80*c* which are internally threaded as at 80*d* to cooperate with the threads 10*y* provided on the mandrel 10 when the mandrel is moved upwardly relative to the supplemental collet 80.

Additionally, the force transfer ring which mounts the radial pin 55 is lengthened to extend upwardly to a position just below the bottom end of the collet ring portion 80*a*. This enlarged force transmitting ring or sleeve 58' abuts the bottom ends of a plurality of peripherally spaced lock segments 85 which are normally held in an internal recess 20*t* provided in the tubular body assemblage 20 by the threaded portion 10*y* of the mandrel 10. A garter spring 85*a* urges the locking segments 85 inwardly.

Thus, in the run-in, relocation or removal position, the supplemental collet 80 has no effect on the relative movements of the mandrel 10 and the tubular body assemblage 20. However, as the mandrel 10 is moved upwardly to effect the setting of the lower slips 54 in the manner previously described, the mandrel threads 10*y* move upwardly past the collet heads 80*c*, and an annular recess 10*x* formed on the exterior of the mandrel 10 moves into alignment with the locking segments 85 and they snap into engagement with such recess under the influence of the garter spring 85*a*. The lock segments 85 thus transfer the upward movement of the mandrel 10 to the supplemental collet 80. Collet 80 is prevented from rotational movement by a radial pin 82 connecting the ring portion 80*a* of collet 80 with an elongated slot 22 formed in the upper portion 20*a* of the tubular body assemblage 20. The pin 82 slot 22 are shown in dotted lines because they are angularly displaced from the slot 21 which receives the torque pin 56*b* of the upper slip 56.

Figure 6A:
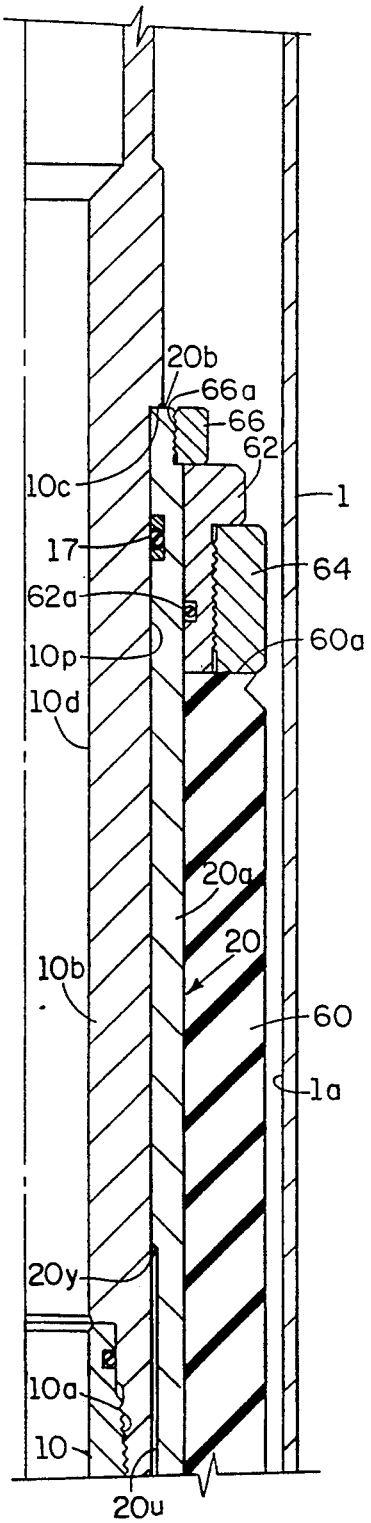
FIGS. 6A, 6B and 6C are views respectively corresponding to FIGS. 1A and 1B but showing the incorporation of a supplemental locking and release collet in its run-in position.
Figure 7A:
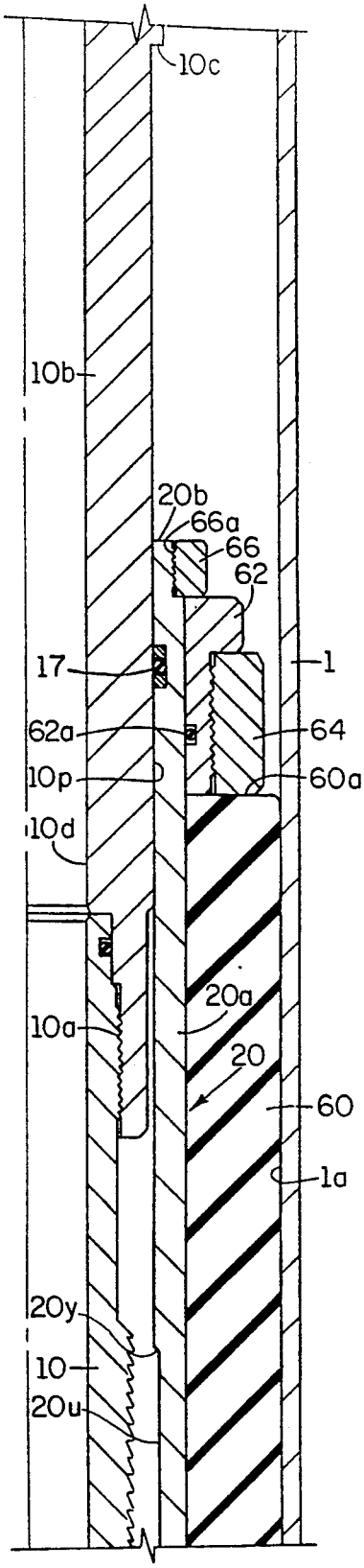
FIGS. 7A, 7B and 7C are views respectively corresponding to FIGS. 6A and 6B but showing the supplemental locking and release collet in its packer setting position.
Figure 6B:
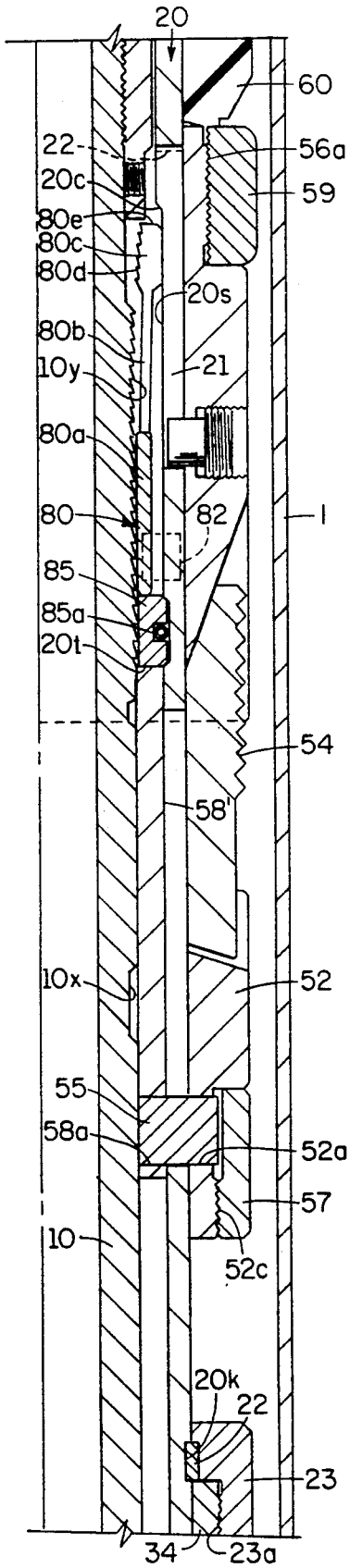
Figure 7B:
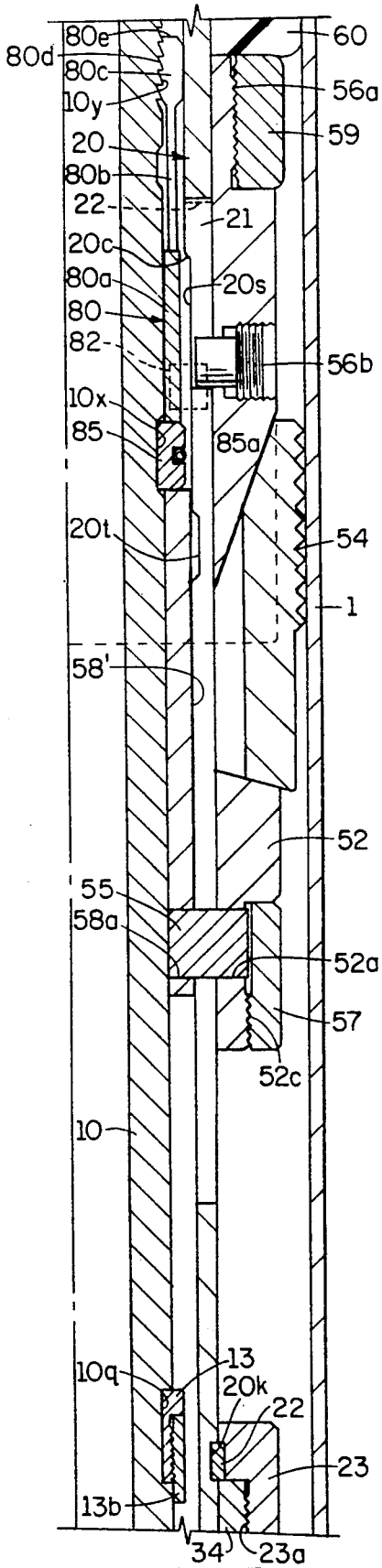
Figure 6C:
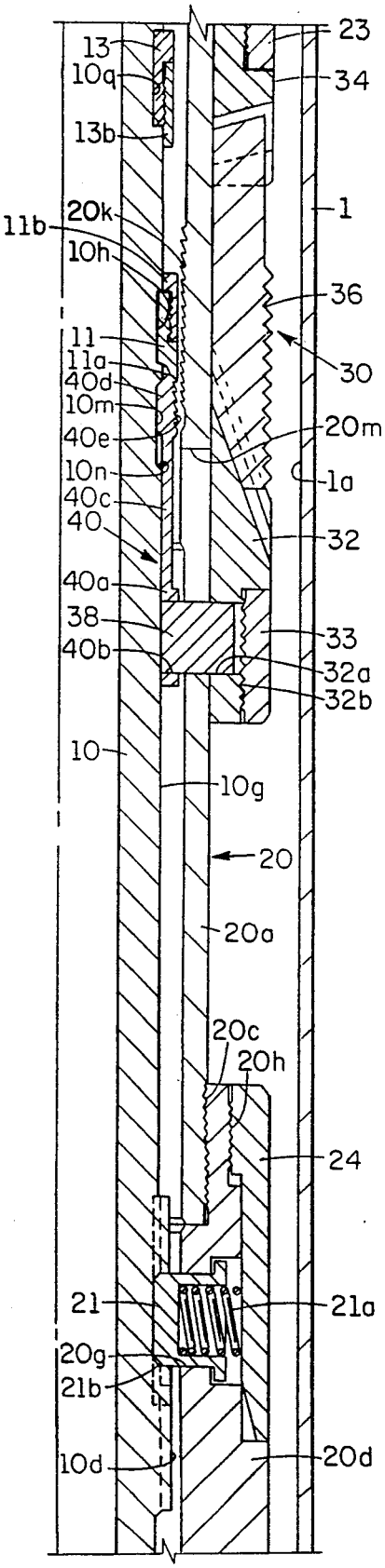
Figure 7C:
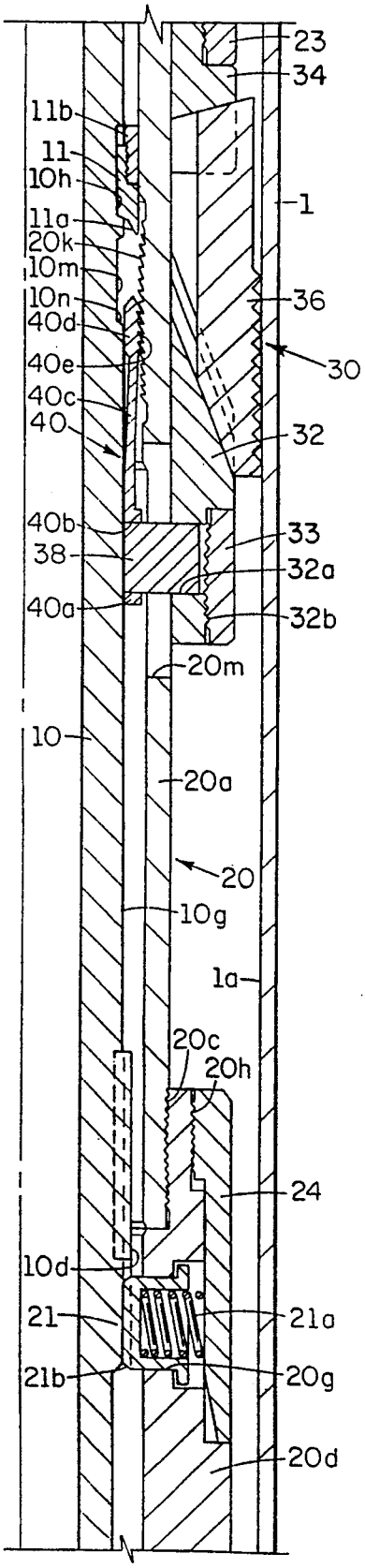

The resulting upward movement of the supplemental collet 80 to the fully set position, brings the top end surface 80*e* of the locking heads 80*c* into engagement with the downwardly facing inclined surface 20*r* which forms the top of an elongated recess 20*s* in tubular body portion 20*a* within which the collet heads 80*c* are mounted. The inclined surface 20*r* forces the collet heads 80*c* inwardly to effect a complete interengagement of collet threads 80*d* with the threaded portion 10*y* of the mandrel 10 which occurs while the mandrel 10 is moving to effect the setting of the upper slips 56 and the compression of the packing element 60 into sealing engagement with the wall of the surrounding well conduit. In the final setting position of the mandrel 10, (FIG. 7B) the collet heads 80*c* are disposed in engagement with the internal surface 20*u* of the tubular body assemblage and hence are prevented from jumping over the mandrel threads 10*y*. Further upward movement of supplemental collet 80 is prevented by a downwardly facing shoulder 20*y* at the top of the surface 20*u* (FIG. 6A).

To effect the unsetting of the packing assemblage incorporating the supplemental collet 80, it is only necessary to rotate the mandrel 10 in a clockwise direction. This moves the mandrel 10 downwardly by the threading action of the collet threads 10*d* against the mandrel threads 10*y*. Such downward movement continues until the top end of the mandrel threads 10*y* pass below the collet threads 80*d*. At this juncture, the mandrel 10 is free to move downwardly to force the locking segments 85 outwardly out of engagement with the mandrel recess 10*x* and permit the mandrel 10 to release the upper slips 56 (and packing 60) by moving the supplemental collet 80 downwardly by the bottom surface of connecting sub 10*b*, which in turn moves the force transmitting ring 58′ downwardly to release the slip carrier 54 from its set position. The unsetting of the lower slips 36 occurs in the same manner as previously described so that both sets of slips are unset and the compressive forces on the packing element 60 are relieved to permit the packing assemblage to be freely moved relative to the well conduit within which it is suspended.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A packing tool for a subterranean well conduit comprising:

a mandrel insertable in the well conduit:

means on the top end of said mandrel for connection to a string extending to the well surface;

a tubular body assemblage surrounding said mandrel;

control dog and slot means connecting said tubular body assemblage to said mandrel for run-in, relocation and removal purposes;

a collet having a ring portion surrounding a medial portion of said mandrel, a plurality of peripherally spaced axially extending arms, and enlarged latching heads on each of said arms, each said latching head having external ratchet threads formed thereon;

thread means on the bore surface of said tubular body assemblage for effecting an elongated ratcheting engagement with said latching heads;

drag block means on said tubular body assemblage engagable with the conduit bore for resisting rotational movement of said tubular body assemblage;

said control dog and slot means being operable by rotational movement of said mandrel in one direction plus tension to move said mandrel upwardly relative to said tubular body assemblage;

lower slip means on said tubular body assemblage settable by upward movement of said collet ring portion;

said mandrel having an annular recess receiving said latching collet heads during run-in, relocation or removal;

said annular recess having an inclined upwardly facing bottom end surface, the initial upward movement of said mandrel engaging said inclined upwardly facing end surface with said collet latching heads to move said collet upwardly with said mandrel to set said lower slip means in engagement with the conduit bore wall;

further upward movement of said mandrel after setting said lower slip means moving said annular recess past said latching heads, thereby securing said collet heads in locked engagement with said tubular body assemblage and securing said lower slip means in setting relationship to the conduit bore wall;

a tubular packing element surrounding the upper portion of said tubular body assemblage;

upper anchor means secured to said upper end of said tubular body assemblage against relative upward movement and abutting the upper end of said packing element;

a tubular upper cone axially slidably mounted on said tubular body assemblage below said packing element;

the upper end of said tubular upper cone being abuttable with the lower end of said packing element;

the lower end of said tubular upper cone defining conical ramps for slips;

a tubular upper slip holder axially slidably mounted on said tubular body assemblage below said upper cone;

a plurality of upper slips mounted on said upper slip holder in peripherally spaced relation, said slips being radially outwardly shiftable relative to said slip holder by upward movement of said slip holder relative to said conical ramps;

said tubular body assemblage defining a first axially extending slot underlying said upper slip holder;

at least one pin radially traversing said first slot and having its outer end engagable with said upper cone holder and its inner end disposed adjacent said mandrel; and abutment means on said mandrel operatively engagable with said pin by said further upward movement of said mandrel after said setting of said lower slips and locking of said collet heads, whereby said further upward movement of said mandrel moves said upper slips and said packing element into engagement with the bore wall of the well conduit.

2. The apparatus of claim 1 wherein said lower slip means comprises:

a tubular lower slip holder secured to said tubular body assemblage;

a plurality of lower slips mounted in said lower slip holder in peripherally spaced, radially shiftable relationship;

a tubular lower cone surrounding said tubular body assemblage and defining a plurality of ramp surfaces respectively engagable with said lower slips by upward movement relative to said tubular body assemblage;

said tubular body assemblage defining a second axial slot beneath said lower cone; and pin means secured to said collet ring portion and traversing said second axial slot for securing said lower cone to said collet for axial co-movement, whereby upward movement of said mandrel to said collet head locking position effects upward movement of said lower cone to set said lower slips.

3. The apparatus defined in claim 1 further comprising control dog and slot means interconnecting said mandrel and said tubular body assemblage for axial co-movement during run-in, relocation or removal;

said control dog and slot means effecting disengagement of said mandrel from said tubular body assemblage by rotation of said mandrel in one direction accompanied by an upward force on said mandrel to release the control dog from the slot;

said control dog and slot means being reengagable by downward movement of said mandrel accompanied by rotation of said mandrel in said one direction.

4. The apparatus defined in claim 2 wherein said control dog and slot means interconnect said mandrel and said tubular body assemblage for axial co-movement during run-in, relocation and removal;

said control dog and slot means effecting disengagement of said mandrel from said tubular body assemblage by rotation of said mandrel in one direction accompanied by an upward force on said mandrel to release the control dog from the slot;

said control dog and slot means being reengagable by downward movement of said mandrel accompanied by rotation of said mandrel in said one direction.

5. The apparatus of claim 1 or 2 wherein said control dog and slot means comprises:

a radially enlarged, axially extending peripheral shoulder on said mandrel defining an axially and peripherally extending groove;

a radially disposed control dog in said tubular body assemblage spring biased into engagement with said groove;

said groove defining an axial run-in portion preventing relative rotational movement of said mandrel and said tubular body assemblage; and a peripherally and axially extending ramp portion permitting radial disengagement of said spring biased control dog with said shoulder by said rotational movement of said mandrel in said one direction accompanied by tension, thereby permitting upward movement of said mandrel to first set said lower slips and then set said upper slips while compressing said elastomeric packing element.

6. A packing tool for a subterranean well conduit comprising:

a mandrel insertable in the well conduit;

means on the top end of said mandrel for connection to a string extending to the well surface;

a tubular body assemblage surrounding said mandrel;

control dog and slot means interconnecting said tubular body assemblage and said mandrel for run-in, said control dog and slot means requiring limited clockwise rotation of said mandrel plus tension to disconnect;

said tubular body assemblage having a downwardly facing, external abutment shoulder on its upper portion;

an annular packing unit surrounding said tubular body assemblage and having a top end abuttable with said abutment shoulder;

an upper slip assembly surrounding said tubular body assemblage and abutting a bottom end of said packing unit;

said upper slip assembly including an upper cone, an upper slip carrier and a plurality of upper slips mounted on said upper slip carrier in peripherally spaced relation and radially movable relative to said upper slip carrier, whereby upward movement of said upper slip assembly expands said upper slips and said packing unit into engagement with the conduit bore wall;

said tubular body assemblage having an upper axial slot underlying said upper slip assembly;

external abutment means on said tubular body assemblage below said upper slip assembly;

a lower slip assembly surrounding said tubular body assemblage below said external abutment means, said lower slip assembly comprising a lower slip carrier including a plurality of lower slips and a lower cone for expanding said lower slips into engagement with said conduit bore;

said tubular body assemblage having a lower axial slot underlying said lower slip assembly;

a first pin means detachably engagable by said mandrel and traversing said lower axial slot to relatively move said lower cone and said lower slips to set said lower slips during initial upward movement of said mandrel relative to said tubular body assemblage; and second pin means traversing said upper axial slot and engagable by further upward movement of said mandrel relative to said tubular body assemblage to move said upper slip assembly upwardly to compress said packing unit to sealingly engage the conduit bore and set said upper slips.

7. The apparatus of claim 6 further comprising lock means operable between said tubular body assemblage and said mandrel to prevent downward movement of said mandrel after setting said lower slips.

8. The apparatus of claim 6 wherein said first pin means comprises a collet having a ring portion surrounding said mandrel, a plurality of peripherally spaced arm portions, and radially enlarged head portions respectively formed on said arm portions, a radial pin secured to said collet ring portion and extending through said lower axial slot to engage said lower slip assembly;

ratchet means interconnecting said collet heads and the bore wall of said tubular body assemblage;

said mandrel having an external recess to receive said collet heads during run-in; and initial upward movement of said mandrel relative to said tubular body assemblage moving said collet heads upwardly, thereby moving said collet upwardly to set said lower slip assembly.

9. The apparatus of claim 8 wherein the external surface of said mandrel below said external recess slidably engages said enlarged collet heads as said mandrel moves further upwardly to secure said collet heads to said tubular body assemblage by preventing relative movement of said ratchet means.

10. The apparatus of claim 8 further comprising lock means operable between said tubular body assemblage and said mandrel to prevent downward movement of said mandrel after setting said lower slips.

11. The apparatus of claim 10 wherein said lock means are disengagable by rotation of said mandrel.

12. The apparatus of claim 11 wherein downward movement of said mandrel during said rotation unsets said upper and lower slip assemblies and re-engages said control dog and slot means to permit retrieval of said packing tool from the well conduit.

13. The method of setting a packing unit in a well conduit with the packing unit disposed above both an upper slip assembly and a lower slip assembly comprising the steps of:

a. providing a tubular body having a first abutment shoulder on its upper end;

b. assembling on said tubular body below said abutment shoulder:

(1) an annular packing unit axially compressible into sealing engagement with the conduit bore wall;

(2) an upper slip assembly having upper slips movable into biting engagement with the conduit bore wall by upward movement of the upper slip assembly;

(3) a second abutment shoulder on said tubular body below said upper slip assembly;

(4) a lower slip assembly abuttable with the second abutment shoulder and having lower slips movable into biting engagement with the conduit bore wall by upward movement of the lower slip assembly; and (5) a drag block unit slidably engagable with the conduit bore;

c. inserting a mandrel in the tubular body;

d. interconnecting the mandrel and tubular body for run-in by a control dog and slot connection;

e. running the mandrel and tubular body into the well conduit by a tubing string connected to the mandrel;

f. rotating the mandrel while applying tension to release said mandrel for upward movement relative to the tubular body;

g. moving said mandrel upwardly to detachably engage said lower slip assembly, to then set said lower slips and disengage from said lower slip assembly;

h. continuing upward movement of the mandrel to bring an external abutment on the mandrel into engagement with the upper slip assembly; and j. continuing upward movement of the mandrel to compress said annular packing unit into sealing engagement with the conduit bore and to set said upper slips.

14. The method of claim 13 further comprising the step of providing ratcheting lock means between the mandrel and the tubular body to prevent downward movement of the mandrel.

15. The method of claim 14 further comprising the steps of:

rotating the mandrel to release the ratcheting lock means; and concurrently moving the mandrel downwardly to successively release said upper and lower slips and said sealing elements and re-engage said control dog and slot means to permit retrieval of the entire apparatus from the well conduit.

16. A packing tool for a subterranean well conduit comprising:

a mandrel insertable in the well conduit;

means on the top end of said mandrel for connection to a string extending to the well surface;

a tubular body assemblage surrounding said mandrel;

control dog and slot means connecting said tubular body assemblage to said mandrel for run-in, relocation and removal purposes;

drag block means on said tubular body assemblage engagable with the conduit bore for resisting rotational movement of said tubular body assemblage;

said control dog and slot means operable by rotation of said mandrel in one direction plus tension to move said mandrel upwardly relative to said tubular body assemblage;

an annular packing element surrounding the upper portion of said tubular body assemblage;

abutment means on said tubular body assemblage adjacent the upper end of said annular packing element;

an annular slip carrier and cone element surrounding said tubular body assemblage below said annular packing element;

a plurality of radially shiftable upper slips mounted on said slip carrier in a peripherally spaced array and operable to a set position in the conduit bore by relative axial movement of said slip carrier and said cone element upwardly to concurrently compress said annular packing element and set said upper slips;

a locking collet surrounding said mandrel and disposed in an annular internal recess in said tubular body assemblage;

said locking collet having a ring portion and peripherally spaced resilient arms terminating in head portions having internal thread segments formed thereon;

means preventing rotation of said collet relative to said tubular body assemblage but permitting axial movements of said collet;

said mandrel having an externally threaded portion movable into ratcheting engagement with said internal thread segments on said locking collet heads;

means for moving said locking collet upwardly out of said recess by said mandrel when said mandrel approaches the fully set position of said slips; and shoulder means on said tubular body assemblage for preventing upward movement of said collet after reaching said fully set position of said slips, whereby release of said mandrel from said locking collet can only be produced by rotation of said collet in said one direction to move downwardly through said threaded segments on said collet heads.

17. A packing tool for a subterranean well conduit, comprising:

a mandrel insertable in the well conduit;

means on the top end of said mandrel for connection to a string extending to the well surface;

a tubular body assemblage surrounding said mandrel;

control dog and slot means connecting said tubular body assemblage to said mandrel for run-in, relocation and removal purposes;

drag block means on said tubular body assemblage engagable with the conduit bore for resisting rotational movement of said tubular body assemblage;

said control dog and slot means operable by rotation of said mandrel in one direction plus tension to move said mandrel upwardly relative to said tubular body assemblage;

an annular packing element surrounding the upper portion of said tubular body assemblage;

abutment means on said tubular body assemblage adjacent the upper end of said annular packing element;

an annular slip carrier and cone element surrounding said tubular body assemblage below said annular packing element;

a plurality of radially shiftable upper slips mounted on said slip carrier in a peripherally spaced array and operable to a set position in the conduit bore by relative axial movement of said slip carrier and said cone element upwardly to concurrently compress said annular packing element and set said upper slips;

a locking collet surrounding said mandrel and disposed in an annular internal recess in said tubular body assemblage;

said locking collet having a ring portion and peripherally spaced resilient arms terminating in head portions having internal thread segments formed thereon;

means preventing rotation of said collet relative to said tubular body assemblage but permitting axial movements of said collet;

said mandrel having an externally threaded portion movable into ratcheting engagement with said internal thread segments on said locking collet heads;

means for moving said locking collet upwardly out of said recess by said mandrel when said mandrel approaches the fully set position of said slips;

shoulder means on said tubular body assemblage for preventing upward movement of said collet after reaching said fully set position of said slips, whereby release of said mandrel from said locking collet can only be produced by rotation of said collet in said one direction to move downwardly through said threaded segments on said collet heads;

a second slip carrier and cone element disposed on said tubular body portion below said first mentioned slip carrier and cone element;

a plurality of radially shiftable second slips mounted on said carrier in a peripherally spaced array and operable to a set position in the conduit bore by relative axial movement of said second slip carrier and cone element;

a second collet having a ring portion surrounding a lower portion of said mandrel;

said second collet having a plurality of peripherally spaced, axially extending resilient arms, and enlarged latching heads on each of said arms, each of said latching heads having external ratchet threads;

said mandrel having an external annular recess receiving said enlarged collet heads during run-in, relocation or removal;

axially extending internal ratchet threads on said tubular body assemblage;

said annular recess on said mandrel having an inclined upwardly facing end surface, the initial upward movement of said mandrel engaging said inclined upwardly facing end surface with said second collet latching heads to move said collet upwardly with said mandrel and ratchetingly engage said collet latching heads with said ratchet threads on said tubular body assemblage; and means for connecting said ring portion of said second collet with one of said slip carrier and said second cone element to relatively move said second slip carrier and cone element to set said second slips in engagement with the conduit wall prior to setting said upper slips.

18. The apparatus of claims 7, 10 or 11 wherein said lock means comprises:

radially shiftable lock segments in said tubular body assemblage spring biased into engagement with said mandrel, said lock segments having internal ratchet threads on their inner ends; and external ratchet thread segments on said mandrel below said lock segments in the run-in positions of said mandrel and said tubular body assemblage, whereby upward movement of said mandrel to set said slips engages said locking segments with said external ratchet threads.

19. The apparatus of claim 16 or 17 further comprising:

radially shiftable lock segments in said tubular body assemblage spring biased into engagement with said mandrel, said lock segments having internal ratchet threads on their inner ends; and external ratchet thread segments on said mandrel below said lock segments in the run-in positions of said mandrel and said tubular body assemblage, whereby upward movement of said mandrel to set said slips engages said locking segments with said external ratchet threads.

* * * * *